US007459863B2

(12) United States Patent
Hsueh et al.

(10) Patent No.: US 7,459,863 B2
(45) Date of Patent: Dec. 2, 2008

(54) TRANSFORMER AND MULTI-LAMP DRIVING CIRCUIT USING THE SAME

(75) Inventors: Ching-Fu Hsueh, Bade (TW); Cheng-Hsien Chien, Taoyuan (TW); Wan-Chin Hsu, Dasi Township, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/862,316

(22) Filed: Sep. 27, 2007

(65) Prior Publication Data

US 2008/0143276 A1 Jun. 19, 2008

(30) Foreign Application Priority Data

Sep. 28, 2006 (TW) ..... 95136007 A

(51) Int. Cl.
*H05B 41/16* (2006.01)

(52) U.S. Cl. ..... 315/282; 315/277; 315/177; 315/294; 315/324; 336/145; 336/183; 336/170; 336/208

(58) Field of Classification Search ..... 315/177, 315/276–278, 282, 294, 312, 324; 336/145, 336/147, 170, 180–183, 208, 212, 221, 222; 345/102

See application file for complete search history.

(56) References Cited

U.S. PATENT DOCUMENTS

| | | | | |
|---|---|---|---|---|
| 7,176,777 | B2 * | 2/2007 | Hsueh et al. | 336/208 |
| 7,242,147 | B2 * | 7/2007 | Jin | 315/177 |
| 7,250,731 | B2 * | 7/2007 | Jin | 315/282 |
| 7,282,868 | B2 * | 10/2007 | Ushijima et al. | 315/277 |
| 2006/0119293 | A1 * | 6/2006 | Chan et al. | 315/312 |
| 2008/0203944 | A1 * | 8/2008 | Sun et al. | 315/294 |

* cited by examiner

*Primary Examiner*—Haissa Philogene
(74) *Attorney, Agent, or Firm*—Thomas, Kayden, Horstemeyer & Risley

(57) ABSTRACT

A transformer for driving multiple lamps includes a core, a primary winding set, a secondary winding set and a balancing winding set. The primary winding set winds around the core and includes a first primary coil. The secondary winding set winds around the core and includes a first secondary coil. The balancing winding set winds around the core and includes a first balancing coil and a second balancing coil which wind around the core in a combinative way. The primary winding set, the secondary winding set and the balancing winding set have the same magnetic-flux loop in the core.

25 Claims, 17 Drawing Sheets

TRANSFORMER AND MULTI-LAMP DRIVING CIRCUIT USING THE SAME

This application claims the benefit of Taiwan application Serial No. 95136007, filed Sep. 28, 2006, the subject matter of which is incorporated herein by reference.

BACKGROUND OF THE INVENTION

1. Field of the Invention

The invention relates in general to a transformer and multi-lamp driving circuit using the same, and more particularly to a transformer for driving multiple lamps and balancing lamp currents simultaneously, and multi-lamp driving circuit using the same.

2. Description of the Related Art

At present, a typical liquid crystal display (LCD) has an inverter with a transformer for generating high-voltage AC signals for driving multiple lamps. In order to equalize lamp currents and thus to achieve the uniform luminance and the lengthened lifetime of each lamp, a balancing transformer for balancing the lamp currents has been adopted.

FIG. 1 (Prior Art) is a schematic diagram showing a conventional multi-lamp driving circuit 100. Referring to FIG. 1, the multi-lamp driving circuit 100 includes a driving circuit 110, a conventional transformer 120 and a balancing transformer 130. The conventional transformer 120 has a primary coil P coupled to the driving circuit 110, and a secondary coil S coupled to first ends of two coils c1 and c2 of the balancing transformer 130. In addition, the two coils c1 and c2 have the same number of windings so as to control two lamps L1 and L2, which are respectively coupled to second ends of the coils c1 and c2, to have substantially the same lamp current.

FIG. 2 (Prior Art) is a schematic diagram showing the balancing transformer 130 of FIG. 1. Referring to FIG. 2, the balancing transformer 130 further includes a core 131 and a bobbin 132 disposed in the core 131. The two coils c1 and c2 individually wind around two sides of the bobbin 132. However, the levels of the magnetic flux and the leakage inductance at each portion of the core 131 are not completely the same according to the actual pattern (e.g., the El-shape core of FIG. 2) of the core 131, and may be influenced by positions of assembled seams so that the amounts of the induced electric potential on the coils c1 and c2 are different from each other. Consequently, the balancing effects on the lamps L1 and L2 are greatly reduced. In addition, when the number of lamps is increased according to the requirement of luminance, the number of the balancing transformers 130 and the circuit complexity are also increased simultaneously so that the cost and the time for assembling the multi-lamp driving circuit 100 cannot be effectively reduced.

Although the conventional multi-lamp driving circuit may have other types of balancing transformers, this condition cannot be avoided. Thus, it is an important subject in this industry to solve the above-mentioned problems.

SUMMARY OF THE INVENTION

The invention is directed to a transformer and multi-lamp driving circuit using the same. Using one single transformer of the invention multiple lamps can be driven to achieve the effect of balancing lamp currents without using the extra balancing transformer. In addition, the transformer of the invention also has coils winding set around a core in a combinative manner so that the time of winding set the coils may be shortened and the better coil coupling property and the better current balancing control may be achieved. Thus, the multi-lamp driving circuit can effectively save the manufacturing cost and simplify the circuit complexity.

According to a first aspect of the present invention, a transformer for driving multiple lamps is provided. The transformer includes a core, a primary winding set, a secondary winding set and a balancing winding set. The primary winding set winds around the core and includes a first primary coil. The secondary winding set winds around the core and includes a first secondary coil. The balancing winding set winds around the core and includes a first balancing coil and a second balancing coil which wind around the core in a combinative way. The primary winding set, the secondary winding set and the balancing winding set have the same magnetic-flux loop in the core.

According to a second aspect of the present invention, a multi-lamp driving circuit for driving several lamps is provided. The multi-lamp driving circuit includes a driving circuit and a transformer. The transformer includes a core, a primary winding set, a secondary winding set and a balancing winding set. The primary winding set winds around the core, is coupled to the driving circuit, and includes a primary coil. The secondary winding set winds around the core and includes a first secondary coil. The balancing winding set winds around the core and includes a first balancing coil and a second balancing coil which wind around the core in a combinative way. The secondary winding set is coupled to the lamps through the balancing winding set. The primary winding set, the secondary winding set and the balancing winding set have the same magnetic-flux loop in the core.

According to a third aspect of the present invention, a multi-lamp driving circuit for driving several lamps is provided. The multi-lamp driving circuit includes a driving circuit and a transformer. The transformer includes a core, a primary winding set, a secondary winding set and a balancing winding set. The primary winding set winds around the core, is coupled to the driving circuit, and includes a primary coil. The secondary winding set winds around the core and includes a secondary coil. The balancing winding set winds around the core and includes a first balancing coil and a second balancing coil which wind around the core in a combinative way. The secondary winding set is coupled to the lamps and is coupled to the balancing winding set through the lamps. The primary winding set, the secondary winding set and the balancing winding set have the same magnetic-flux loop in the core.

According to a fourth aspect of the present invention, a multi-lamp driving circuit for driving a first lamp and a second lamp is provided. The multi-lamp driving circuit includes a driving circuit and a transformer. The transformer includes a core, a primary winding set, a secondary winding set and a balancing winding set. The primary winding set winds around the core, is coupled to the driving circuit, and includes a primary coil. The secondary winding set winds around the core and includes a first secondary coil. The balancing winding set winds around the core and includes a first balancing coil and a second balancing coil which wind around the core in a combinative way, and a third balancing coil and a fourth balancing coil which wind around the core in a combinative way. Two ends of the first lamp are respectively coupled to first ends of the second and third balancing coils. Two ends of the second lamp are respectively coupled to first ends of the first and fourth balancing coils. The first and second lamps are coupled to the first secondary coil through the first to fourth balancing coils. The primary winding set, the secondary winding set and the balancing winding set have the same magnetic-flux loop in the core.

The invention will become apparent from the following detailed description of the preferred but non-limiting embodiments. The following description is made with reference to the accompanying drawings.

DETAILED DESCRIPTION OF THE INVENTION

FIRST EMBODIMENT

Figure 3:
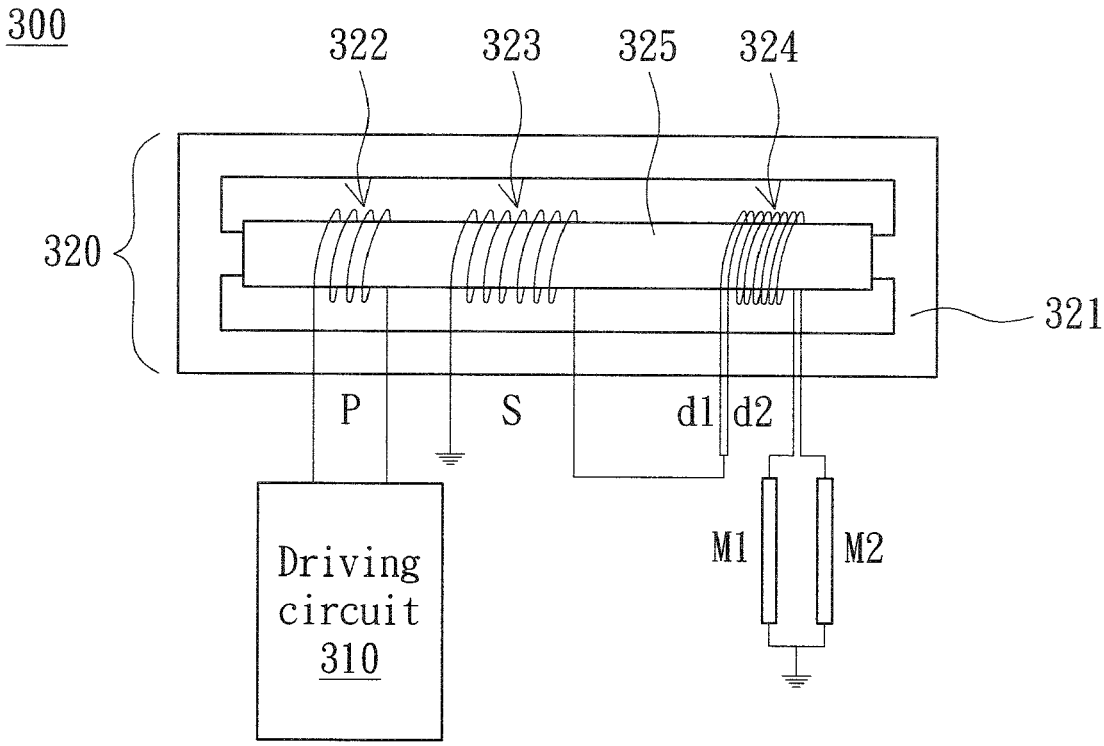
FIG. 3 is a schematic diagram showing a multi-lamp driving circuit according to a first embodiment of the invention.

FIG. 3 is a schematic diagram showing a multi-lamp driving circuit 300 according to a first embodiment of the invention. Referring to FIG. 3, the multi-lamp driving circuit 300 includes a driving circuit 310 and a transformer 320. The driving circuit 310 drives lamps M1 and M2 through the transformer 320. The transformer 320 includes a core 321, a primary winding set 322, a secondary winding set 323, a balancing winding set 324 and a bobbin 325 disposed in the core 321.

As shown in FIG. 3, the primary winding set 322, the secondary winding set 323 and the balancing winding set 324 sequentially wind around the bobbin 325 and have the same magnetic-flux loop in the core 321. In addition, the primary winding set 322 includes a primary coil P coupled to the driving circuit 310, and the secondary winding set 323 includes a secondary coil S. The balancing winding set 324 includes a first balancing coil d1 and a second balancing coil d2, which wind around the core in a combinative way (to be described in detail hereinbelow), and have substantially the same number of windings. In addition, first ends of the first and second balancing coils d1 and d2 are respectively coupled to first ends of the lamps M1 and M2, and second ends of the first and second balancing coils d1 and d2 are coupled to a first end of the secondary coil S. Second ends of the secondary coil S and the lamps M1 and M2 are grounded. The secondary winding set 323 is thus coupled to the lamps M1 and M2 through the balancing winding set 324.

Figure 1:
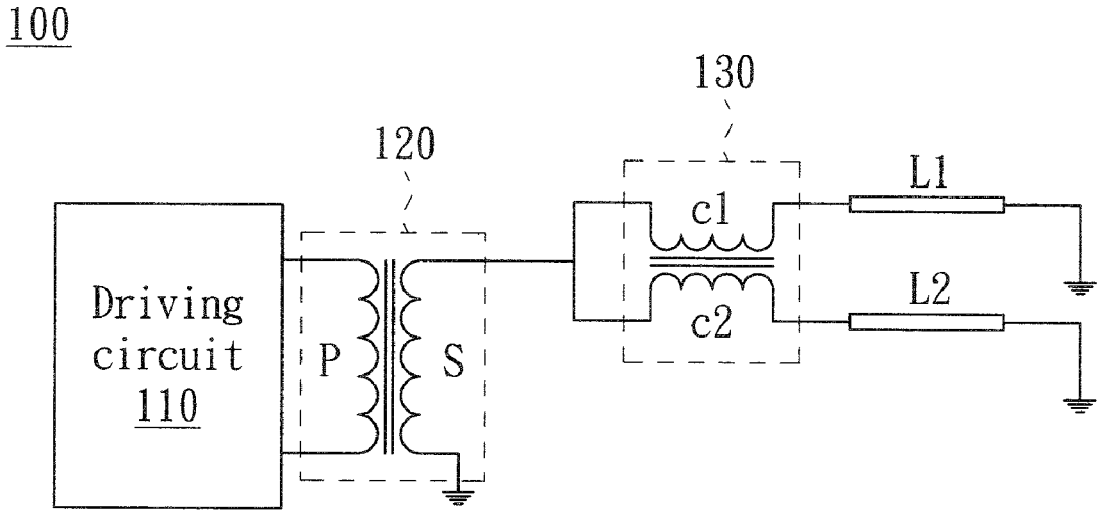
FIG. 1(PRIOR ART)
FIG. 1 (Prior Art) is a schematic diagram showing a conventional multi-lamp driving circuit.
Figure 2:
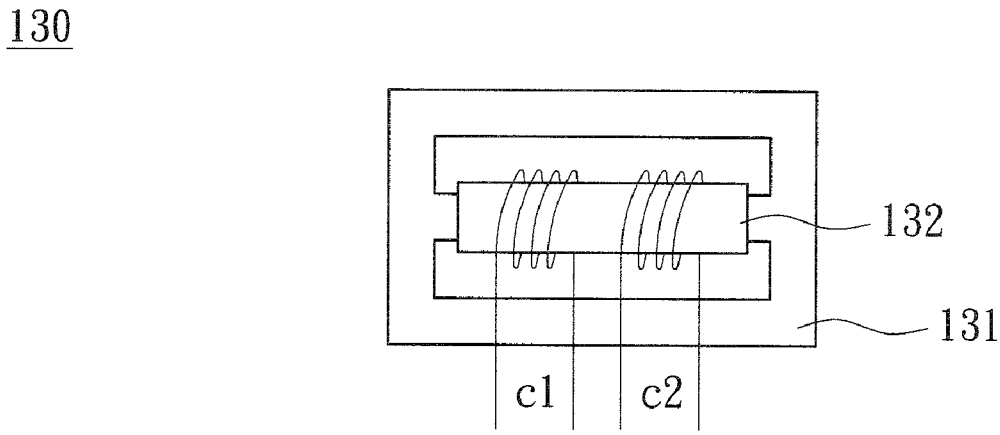
FIG. 2(PRIOR ART)
FIG. 2 (Prior Art) is a schematic diagram showing a balancing transformer 130 of FIG. 1.

Compared with the prior art, the transformer 320 of the invention is equivalent to integrating the conventional transformer and balancing transformer of the inverter. Thus, the single transformer may be used to drive the lamps (using the primary winding set 322 and the secondary winding set 323), and to balance the lamp currents (using the balancing winding set 324) so that the circuit arrangement of the multi-lamp driving circuit 300 is simpler. In addition, the coils d1 and d2 of the balancing winding set 324 having the same number of windings are further different from those in an individually independent winding manner (see FIG. 2) according to the prior art, and wind around the core in a combinative manner. That is, the wire bodies of the coils d1 and d2 are disposed adjacent to each other and wind around the bobbin 325 at the same position in parallel. Consequently, different extents of current balancing effects of the conventional two coils on the lamps may be greatly reduced.

Figure 4:
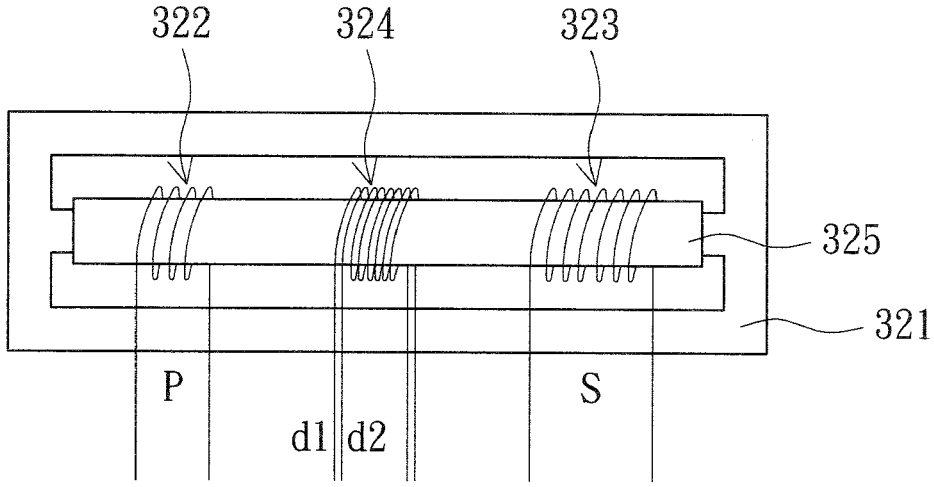
FIG. 4 is another schematic diagram showing a transformer according to the first embodiment of the invention.

FIG. 4 is another schematic diagram showing the transformer according to the first embodiment of the invention. The transformer of the embodiment is different from that of FIG. 3 in that the balancing winding set 324 of the transformer 320 of FIG. 4 is disposed between the primary winding set 322 and the secondary winding set 323. In this case, the multi-lamp driving circuit using the transformer 320 of FIG. 4 may obtain the same effect as that of FIG. 3.

SECOND EMBODIMENT

Figure 5:
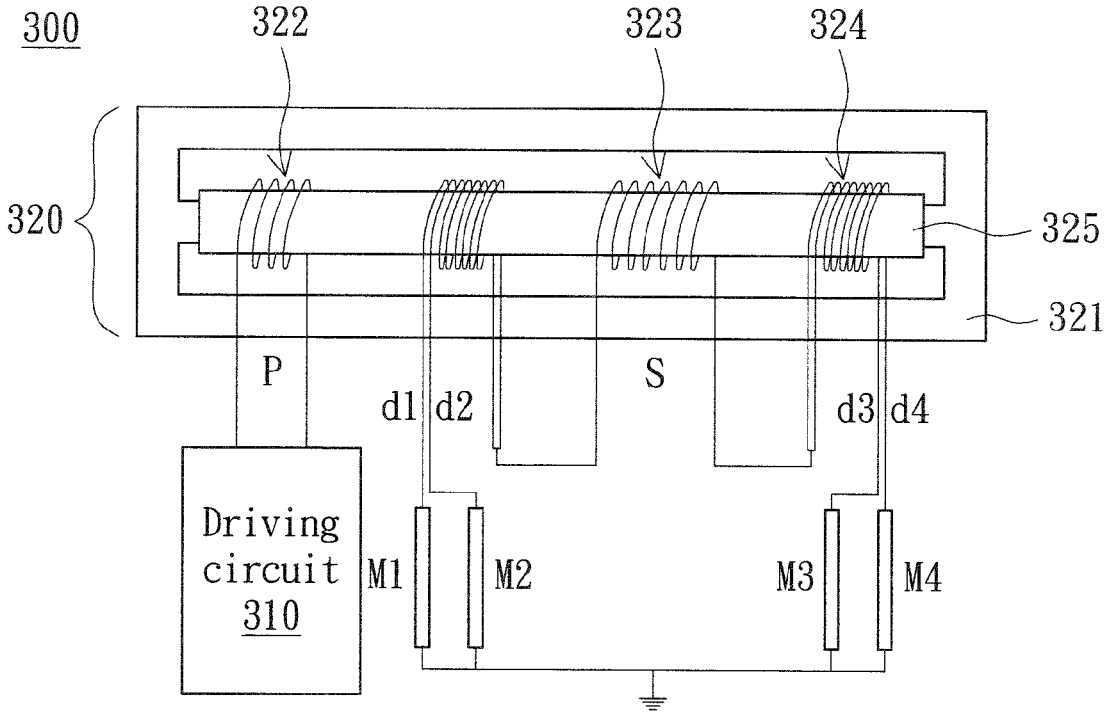
FIG. 5 is a schematic diagram showing a multi-lamp driving circuit according to a second embodiment of the invention.

FIG. 5 is a schematic diagram showing a multi-lamp driving circuit according to a second embodiment of the invention. As shown in FIG. 5, the multi-lamp driving circuit 300 of the embodiment is different from that of FIG. 3 in that the balancing winding set 324 of FIG. 5 further includes a third balancing coil d3 and a fourth balancing coil d4 which wind the core in a combinative way, the first balancing coil d1 (d2) is disposed between the primary winding set 322 and the secondary winding set 323, and the secondary winding set 323 is disposed between the first balancing coil d1 (d2) and the third balancing coil d3 (d4). First ends of the first to fourth balancing coils d1 to d4 are respectively coupled to first ends of the four lamps M1 to M4, second ends of the first to fourth balancing coils d1 to d4 are respectively coupled to two ends of the secondary coil S, and second ends of the lamps M1 to M4 are grounded.

As mentioned above, the multi-lamp driving circuit 300 of FIG. 5 still can obtain the above-mentioned effect according to the balancing coil arrangement shown in the drawing. In addition, it is known that only the corresponding balancing coil or coils must be added when the number of lamps increases, and it is unnecessary to add several balancing transformers as in the prior art and thus the cost can be greatly reduced.

THIRD EMBODIMENT

Figure 6:
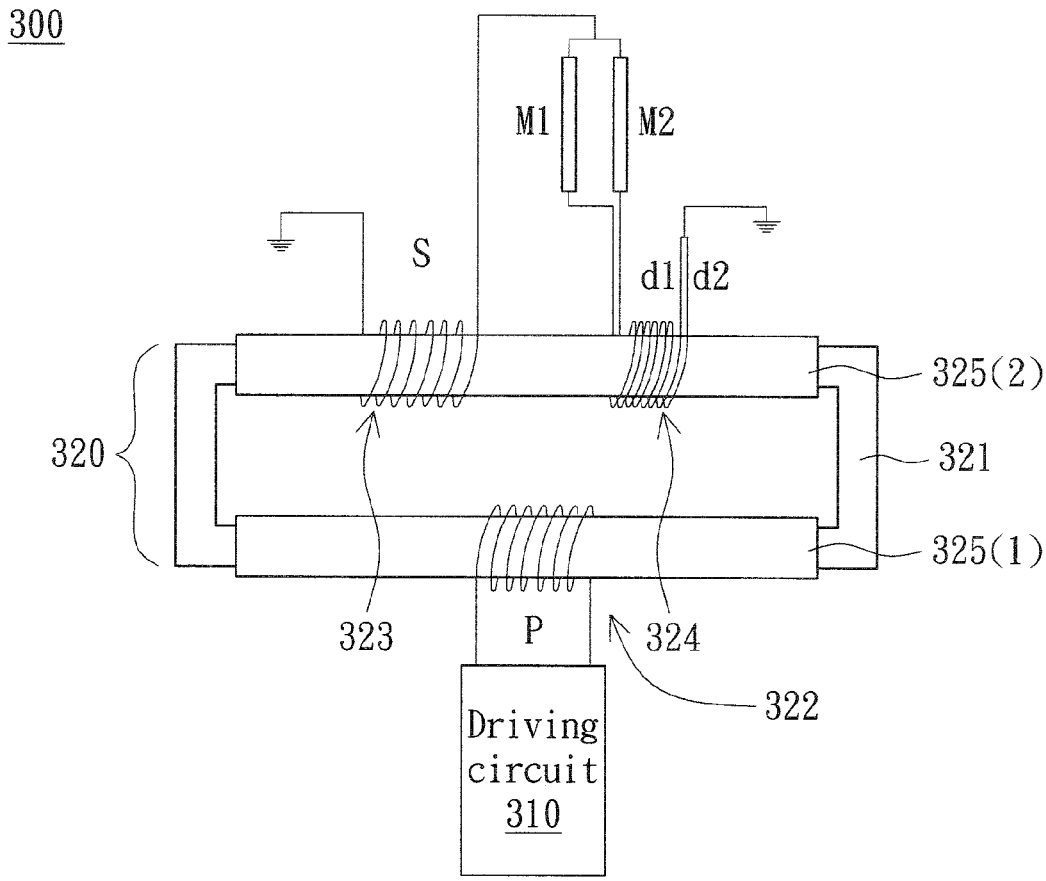
FIG. 6 is a schematic diagram showing a multi-lamp driving circuit according to a third embodiment of the invention.

FIG. 6 is a schematic diagram showing a multi-lamp driving circuit according to a third embodiment of the invention. As shown in FIG. 6, the multi-lamp driving circuit 300 of the embodiment is different from that of the first and second embodiments in that the transformer 320 of FIG. 6 adopts a rectangular core 321 in which two bobbins 325(1) and 325(2) are disposed, wherein the primary winding set 322 winds around the bobbin 325(1), and the secondary winding set 323 and the balancing winding set 324 wind around the bobbin 325(2). In addition, the first ends of the first and second balancing coils d1 and d2 are respectively coupled to the first ends of the lamps M1 and M2, the second ends of the lamps M1 and M2 are coupled to the first end of the secondary coil S, and the second ends of the first and second balancing coils d1 and d2 and the secondary coil S are grounded. The secondary winding set 323 is coupled to the balancing winding set 324 through the lamps M1 and M2. As mentioned above, it is obtained that the arrangement of the multi-lamp driving circuit 300 of FIG. 6 still can obtain the above-mentioned effect.

Figure 7:
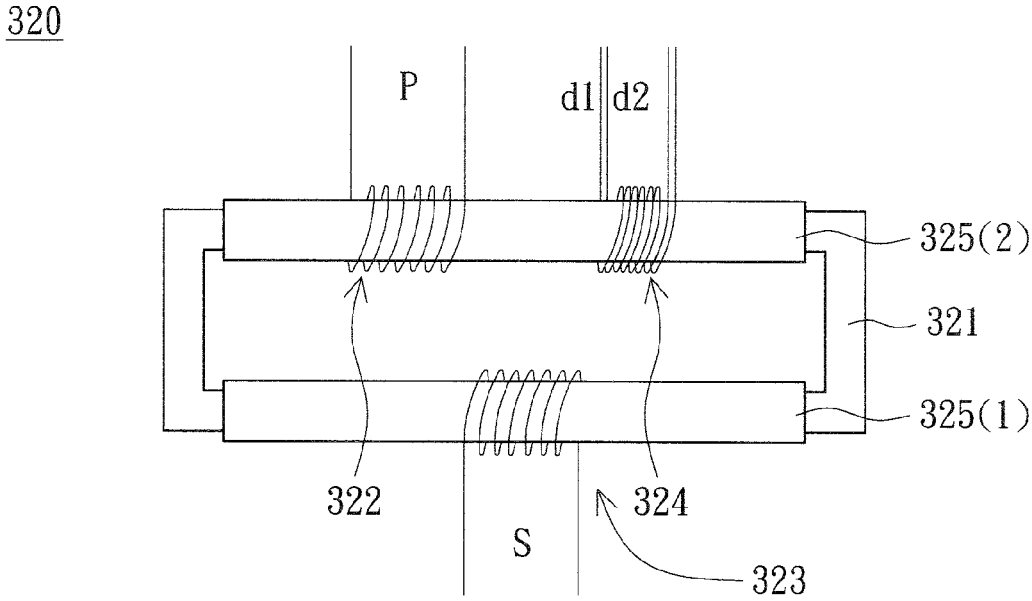
FIG. 7 is another schematic diagram showing a transformer according to the third embodiment of the invention.

FIG. 7 is another schematic diagram showing the transformer according to the third embodiment of the invention. As shown in FIG. 7, the transformer 320 of the embodiment is different from that of FIG. 6 in that the secondary winding set 323 winds around the bobbin 325(1) and the primary winding set 322 and the balancing winding set 324 wind around the bobbin 325(2) in the transformer 320 of FIG. 7. In this case, applying the multi-lamp driving circuit of the transformer 320 of FIG. 7 still can obtain the above-mentioned effect.

FOURTH EMBODIMENT

Figure 8:
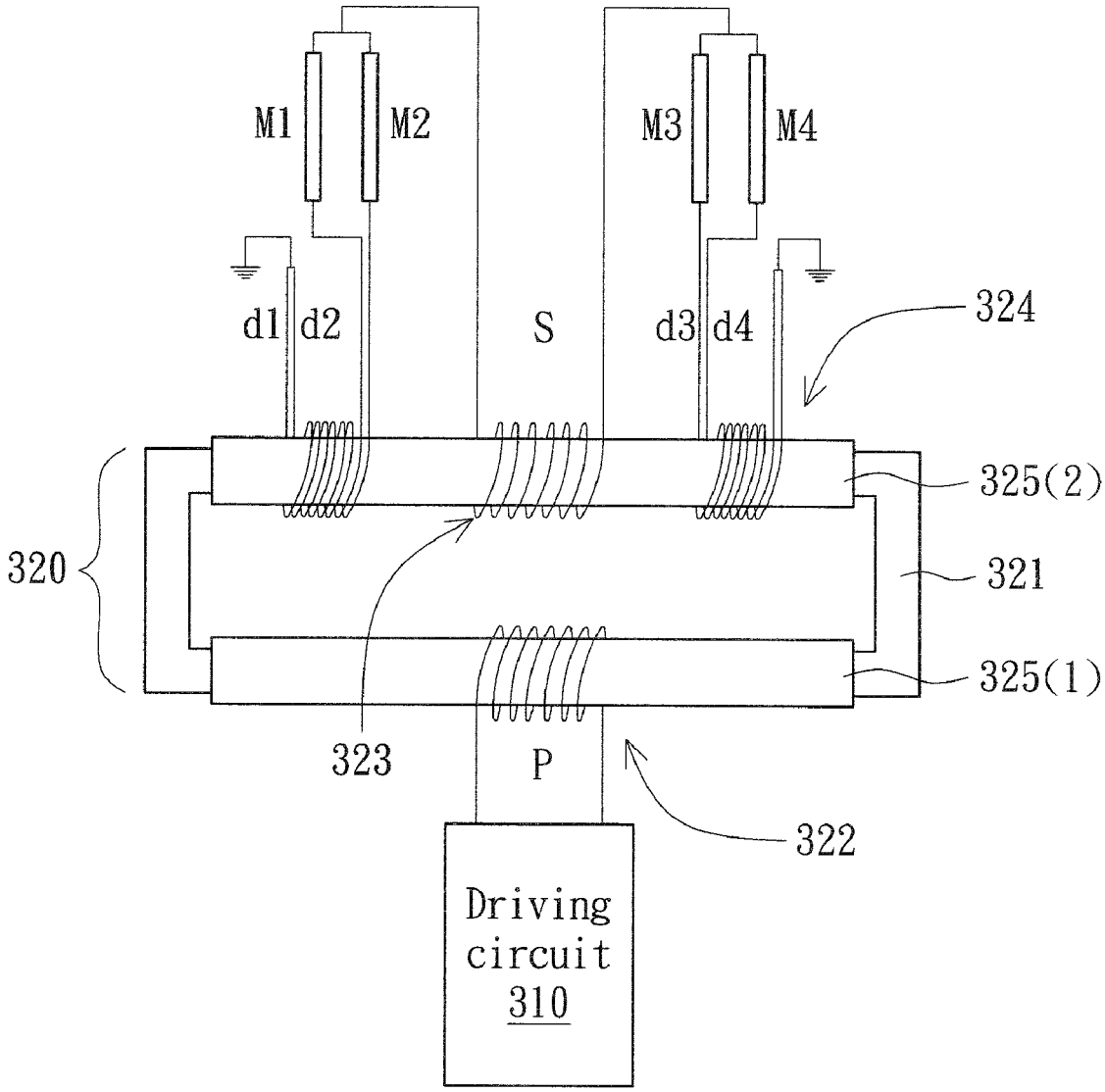
FIG. 8 is a schematic diagram showing a multi-lamp driving circuit according to a fourth embodiment of the invention.

FIG. 8 is a schematic diagram showing a multi-lamp driving circuit according to a fourth embodiment of the invention. As shown in FIG. 8, the multi-lamp driving circuit 300 of the embodiment is different from that of FIG. 6 in that the balancing winding set 324 of FIG. 8 further includes a third balancing coil d3 and a fourth balancing coil d4 which wind around the core in a combinative way, and the secondary winding set 323 is disposed between the first balancing coil d1 (d2) and the third balancing coil d3 (d4). In addition, the first ends of the first to fourth balancing coils d1 to d4 are respectively coupled to the first ends of the lamps M1 to M4, the second ends of the lamps M1 to M4 are respectively coupled to the two ends of the secondary coil S, and the second ends of the first to fourth balancing coils d1 to d4 are grounded. As mentioned hereinabove, it is obtained that the arrangement of the multi-lamp driving circuit 300 of FIG. 8 still can obtain the above-mentioned effect.

FIFTH EMBODIMENT

Figure 9:
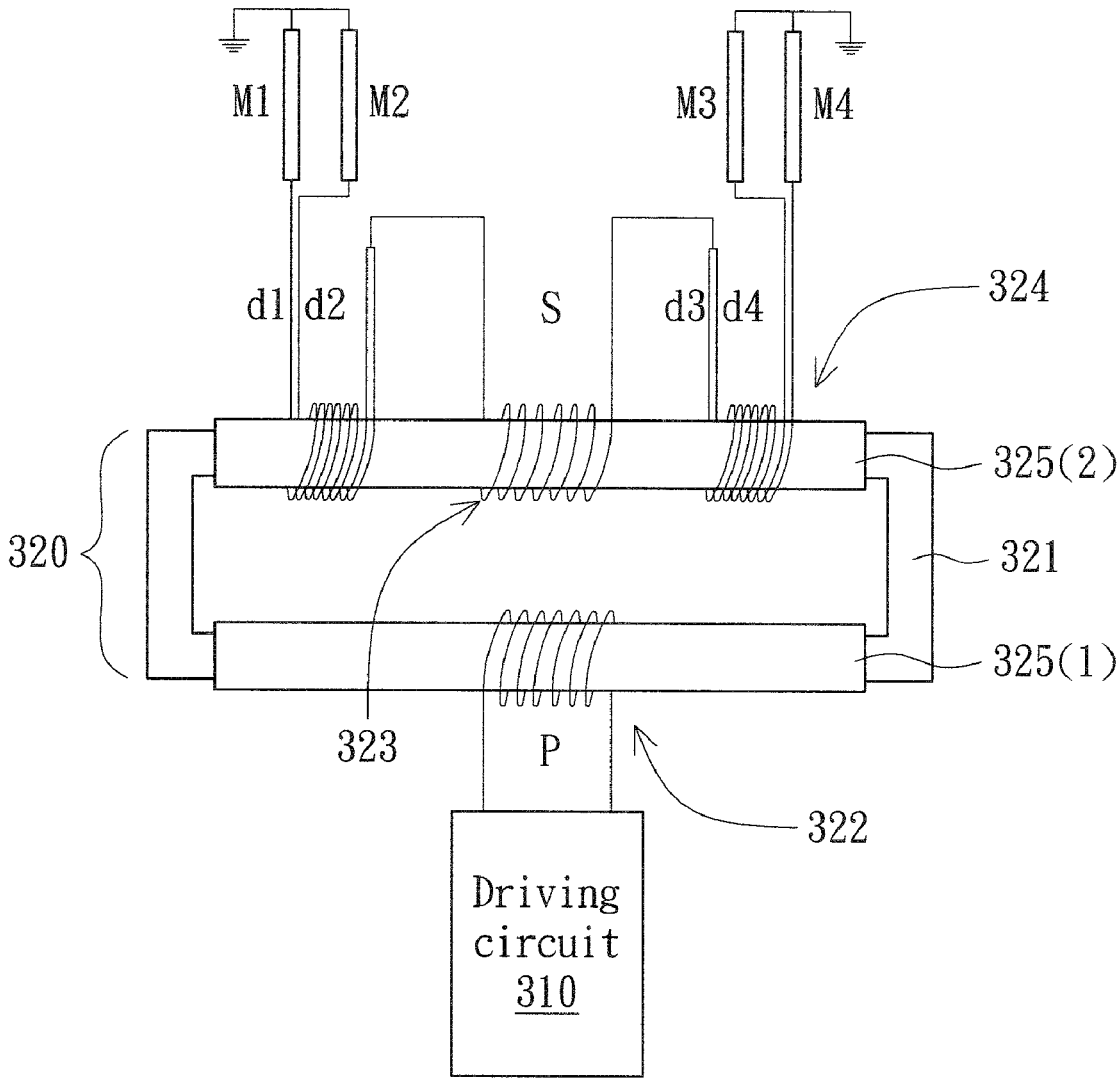
FIG. 9 is a schematic diagram showing a multi-lamp driving circuit according to a fifth embodiment of the invention.

FIG. 9 is a schematic diagram showing a multi-lamp driving circuit according to a fifth embodiment of the invention. As shown in FIG. 9, the multi-lamp driving circuit 300 of the embodiment is different from that of FIG. 8 in that the first ends of the first to fourth balancing coils d1 to d4 of FIG. 9 are respectively coupled to the two ends of the secondary coil S, the first ends of the lamps M1 and M2 and the first ends of the lamps M3 and M4 are respectively coupled to the second ends of the first and second balancing coils d1 and d2 and the second ends of the third and fourth balancing coils d3 and d4. The second ends of the lamps M1 to M4 are grounded. As mentioned above, it is obtained that the arrangement of the multi-lamp driving circuit 300 of FIG. 9 still can obtain the above-mentioned effect.

SIXTH EMBODIMENT

Figure 10:
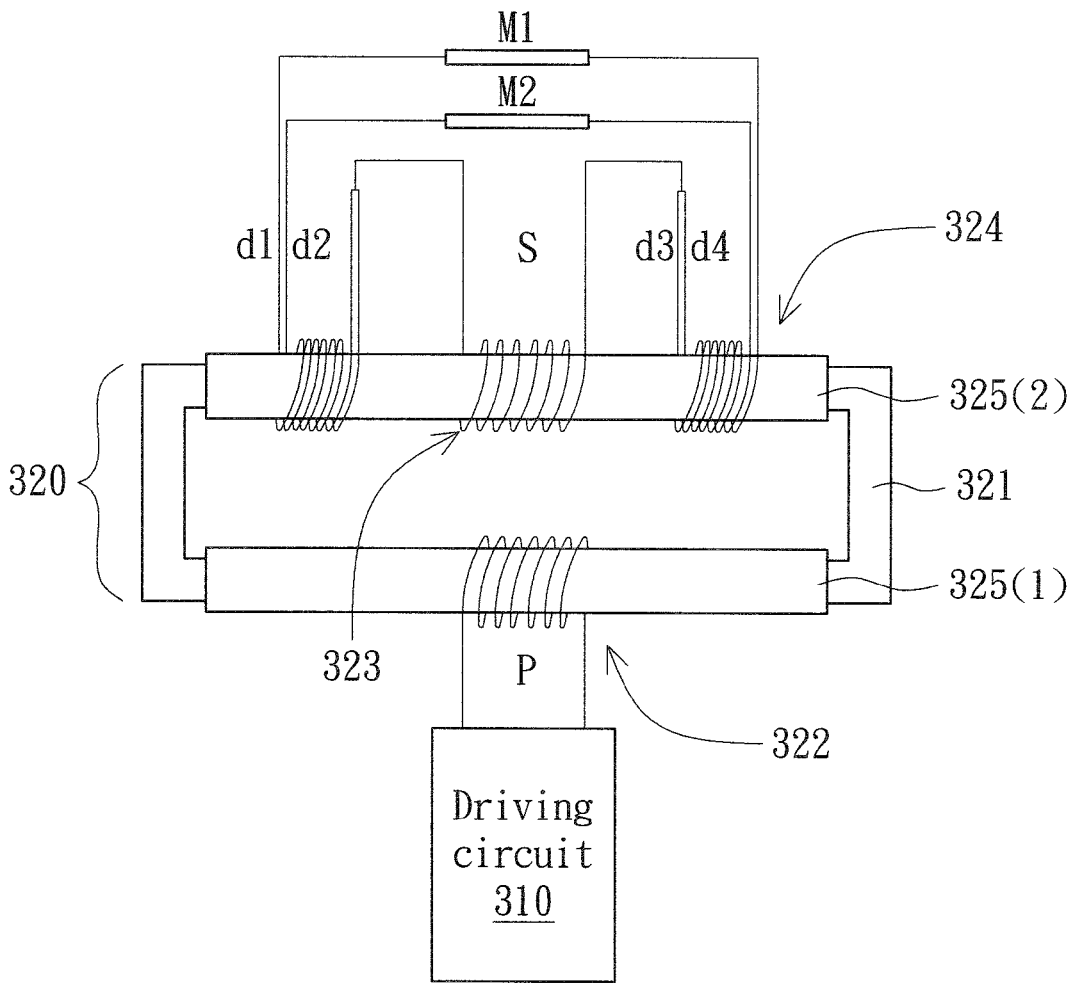
FIG. 10 is a schematic diagram showing a multi-lamp driving circuit according to a sixth embodiment of the invention.

FIG. 10 is a schematic diagram showing a multi-lamp driving circuit according to a sixth embodiment of the invention. As shown in FIG. 10, the multi-lamp driving circuit 300 of the embodiment is different from that of FIG. 8 in that the first ends of the first to fourth balancing coils d1 to d4 are respectively coupled to the two ends of the secondary coil S, the second ends of the first and second balancing coils d1 and d2 are respectively coupled to the first ends of the lamps M1 and M2, and the second ends of the third and fourth balancing coils d3 and d4 are respectively coupled to the second ends of the lamps M1 and M2. Thus, the lamps M1 and M2 are coupled to the secondary coil S through the first to fourth balancing coils d1 to d4. As mentioned above, the arrangement of the multi-lamp driving circuit 300 of FIG. 10 still can obtain the above-mentioned effect.

SEVENTH EMBODIMENT

Figure 11:
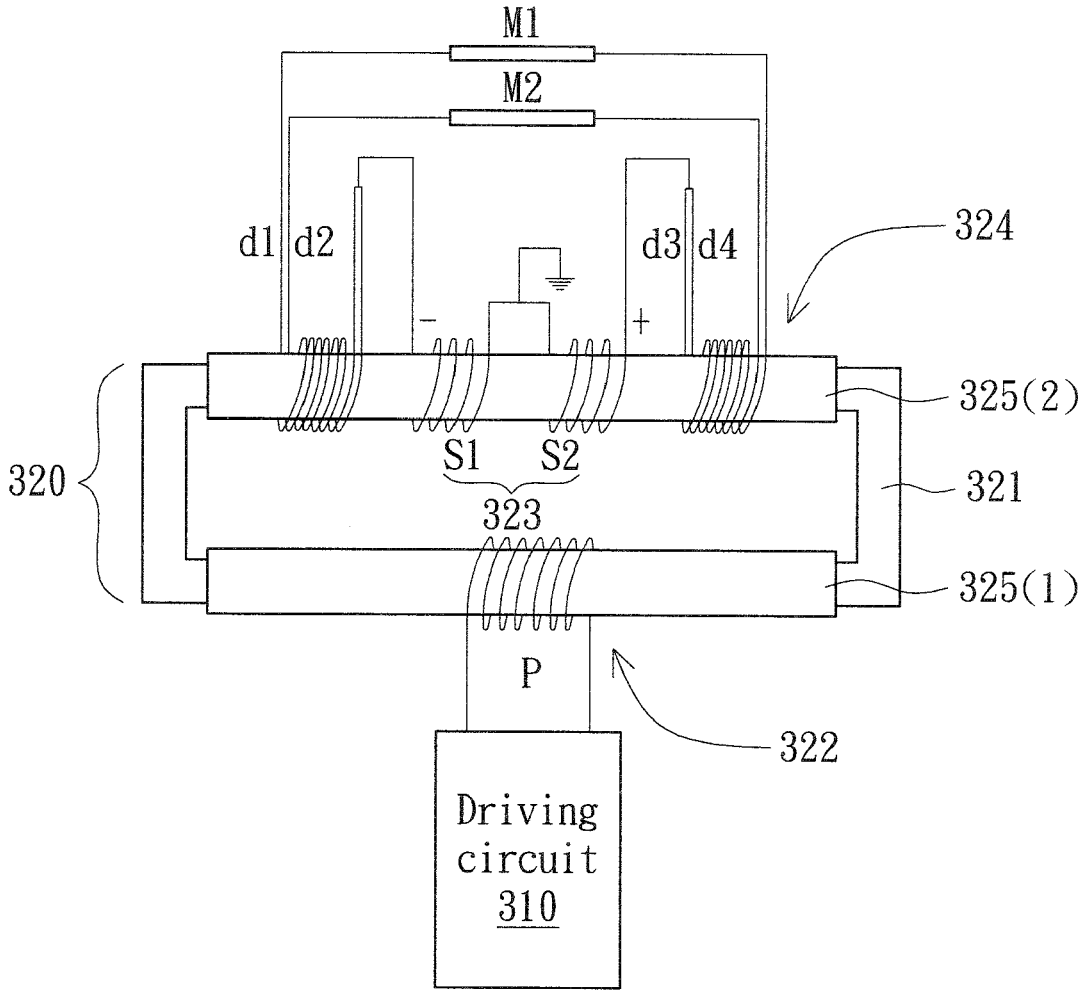
FIG. 11 is a schematic diagram showing a multi-lamp driving circuit according to a seventh embodiment of the invention.

FIG. 11 is a schematic diagram showing a multi-lamp driving circuit according to a seventh embodiment of the invention. As shown in FIG. 11, the multi-lamp driving circuit 300 of the embodiment is different from that of FIG. 10 in that the secondary winding set 323 of FIG. 11 includes two secondary coils S1 and S2. In addition, the first ends of the first to fourth balancing coils d1 to d4 are respectively coupled to the first ends of the secondary coils S1 and S2, and the second ends of the secondary coils S1 and S2 are grounded.

EIGHTH EMBODIMENT

Figure 12:
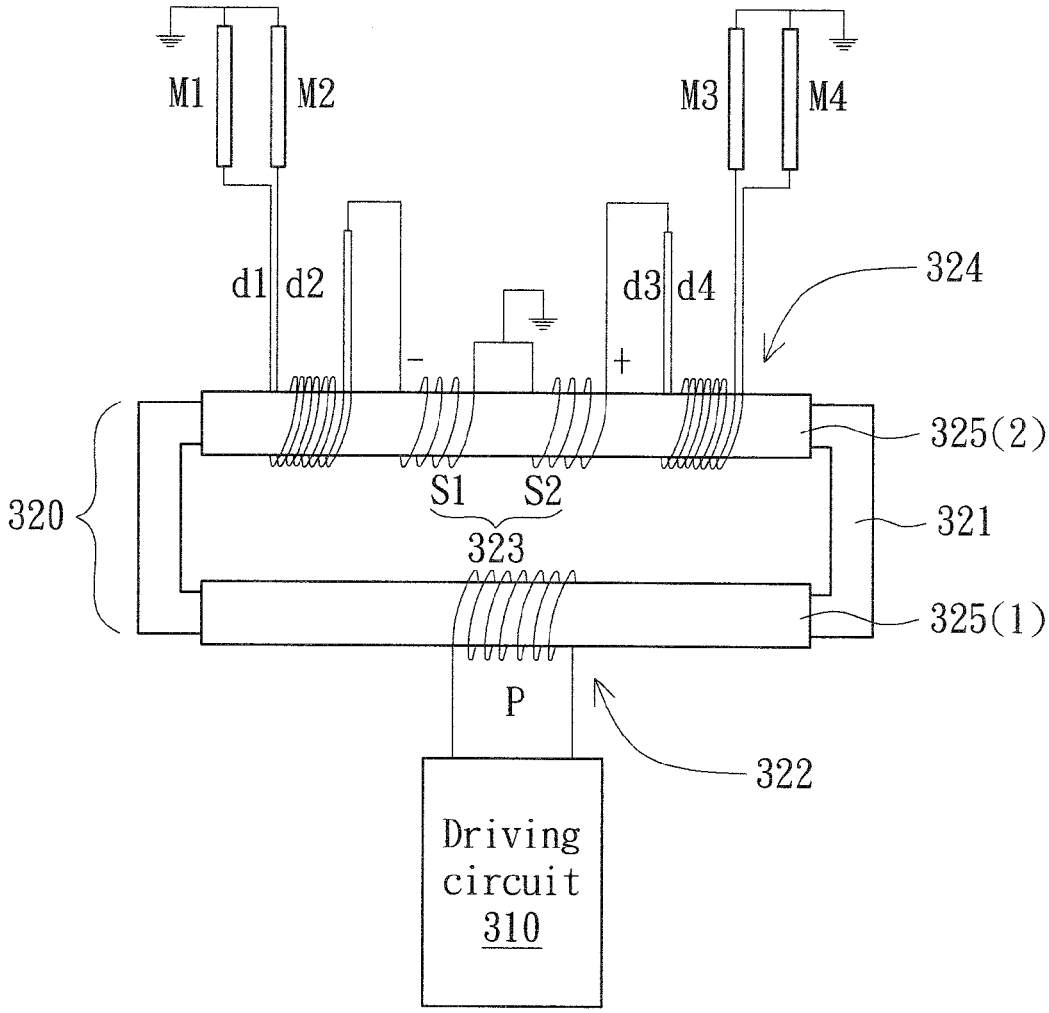
FIG. 12 is a schematic diagram showing a transformer according to an eighth embodiment of the invention.

FIG. 12 is a schematic diagram showing a transformer according to an eighth embodiment of the invention. As shown in FIG. 12, the multi-lamp driving circuit 300 of the embodiment is different from that of FIG. 11 in that the second ends of the first and second balancing coils d1 and d2 are respectively coupled to the first ends of the lamps M1 and M2, the second ends of the third and fourth balancing coils d3 and d4 are respectively coupled to the first ends of the lamps M3 and M4, and the second ends of the lamps M1 to M4 are grounded.

NINTH EMBODIMENT

Figure 13:
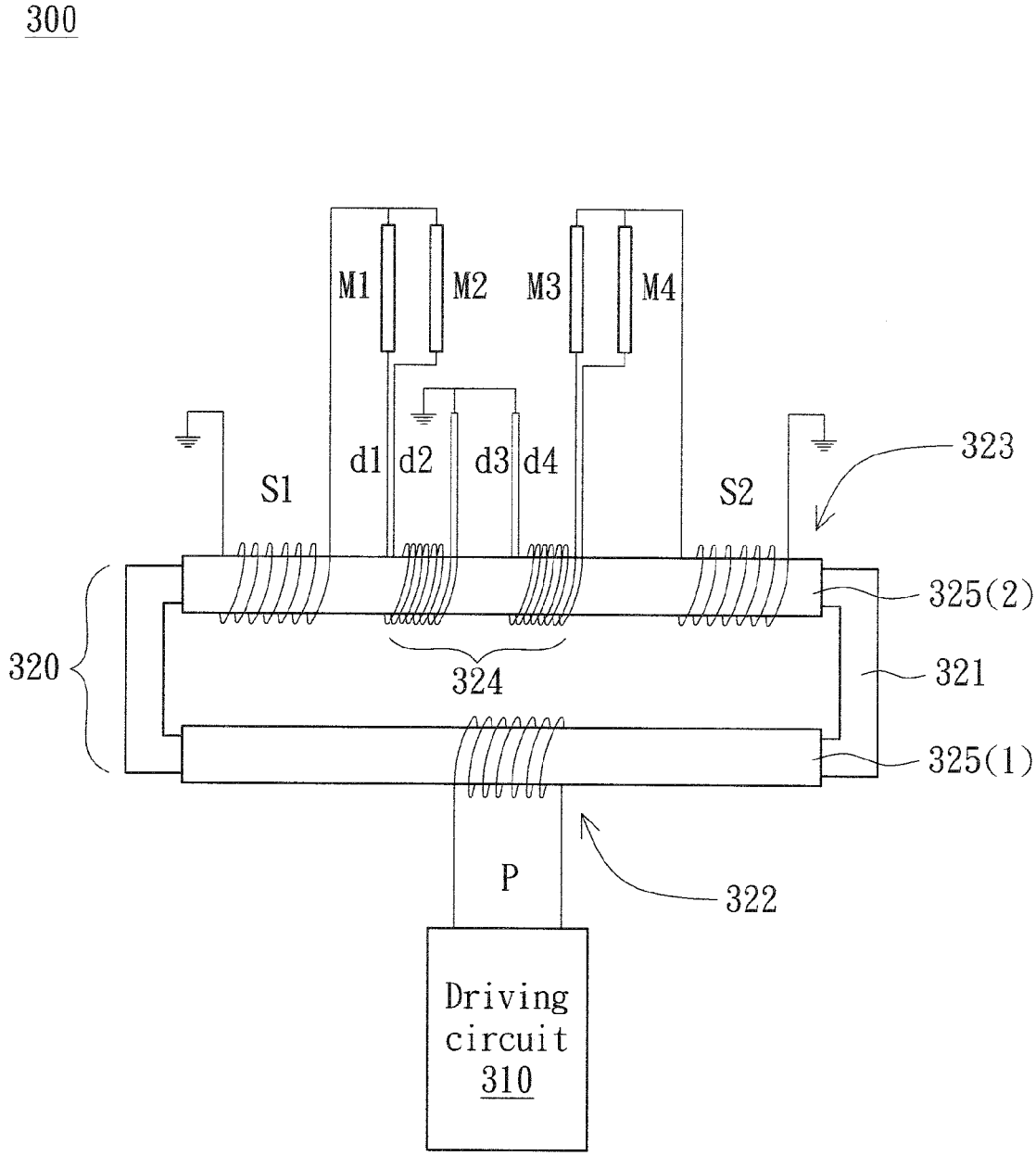
FIG. 13 is a schematic diagram showing a transformer according to a ninth embodiment of the invention.

FIG. 13 is a schematic diagram showing a transformer according to a ninth embodiment of the invention. As shown in FIG. 13, the multi-lamp driving circuit 300 of the embodiment is different from that of FIG. 6 in that the secondary winding set 323 of FIG. 13 includes two secondary coils S1 and S2, and the balancing winding set 324 disposed between the secondary coils S1 and S2 further includes third and fourth balancing coils d3 and d4 which wind around the core in a combinative way. In addition, the first ends of the first to fourth balancing coils d1 to d4 are respectively coupled to the first ends of the lamps M1 to M4, and the second ends of the first to fourth balancing coils d1 to d4 are grounded. The first ends of the secondary coils S1 and S2 are respectively coupled to the second ends of the lamps M1 to M4, and the second ends of the secondary coils S1 and S2 are grounded. As mentioned above, the arrangement of the multi-lamp driving circuit 300 of FIG. 13 still can obtain the above-mentioned effect.

TENTH EMBODIMENT

Figure 14:
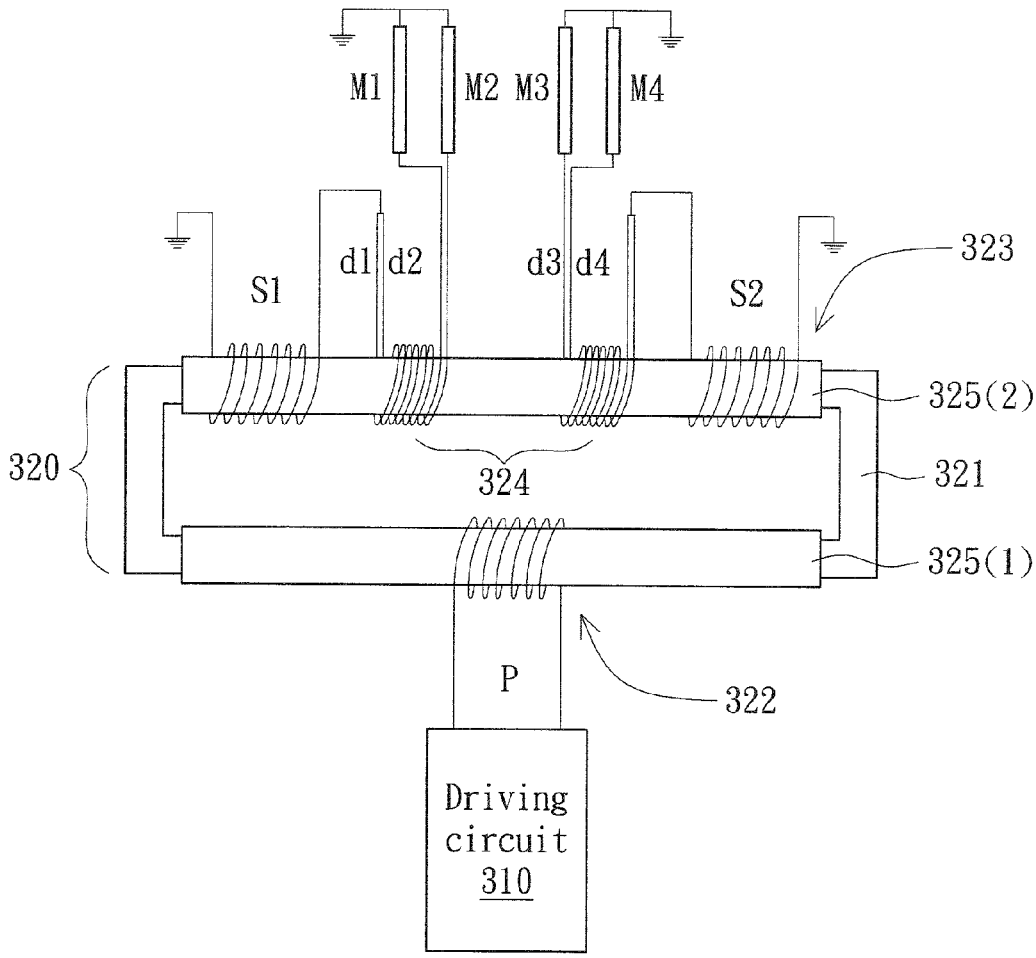
FIG. 14 is a schematic diagram showing a transformer according to a tenth embodiment of the invention.

FIG. 14 is a schematic diagram showing a transformer according to a tenth embodiment of the invention. As shown in FIG. 14, the transformer 320 of the embodiment is different from that of FIG. 13 in that the second ends of the first to fourth balancing coils d1 to d4 are respectively coupled to the first ends of the secondary coils S1 and S2, and the second ends of the lamps M1 to M4 are grounded. As mentioned above, the arrangement of the multi-lamp driving circuit 300 of FIG. 14 still can obtain the above-mentioned effect.

The above-mentioned embodiments disclose several arrangements between the winding sets of the transformer of the invention, and several circuit architectures applied to the multi-lamp driving circuit. In the following, other possible implementations of the transformer of the invention will be described.

ELEVENTH EMBODIMENT

Figure 15:
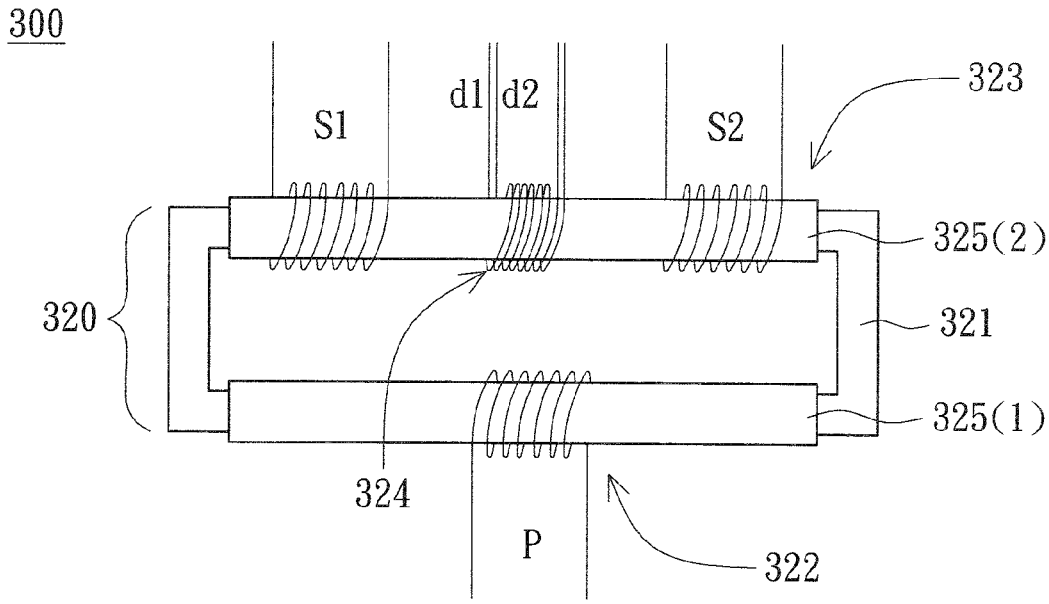
FIG. 15 is a schematic diagram showing a transformer according to an eleventh embodiment of the invention.

FIG. 15 is a schematic diagram showing a transformer according to an eleventh embodiment of the invention. As shown in FIG. 15, the multi-lamp driving circuit 300 of the embodiment is different from those of FIGS. 13 and 14 in that the balancing winding set 324 only utilizes one set of balancing coils d1 and d2 which wind around the core in a combinative way in the transformer 320 of FIG. 15.

TWELFTH EMBODIMENT

Figure 16:
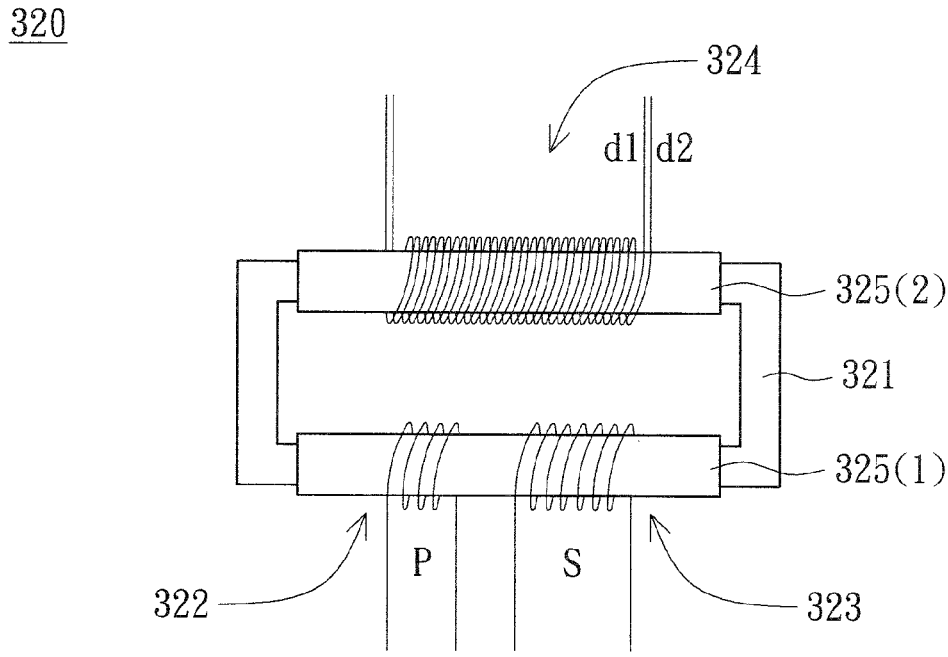
FIG. 16 is a schematic diagram showing a transformer according to a twelfth embodiment of the invention.

FIG. 16 is a schematic diagram showing a transformer according to a twelfth embodiment of the invention. As shown in FIG. 16, the transformer 320 of the embodiment is different from that of FIG. 6 in that the primary winding set 322 and the secondary winding set 323 wind around the bobbin 325(1), and the balancing winding set 324 winds around the bobbin 325(2) in the transformer 320 of FIG. 16.

THIRTEENTH EMBODIMENT

Figure 17:
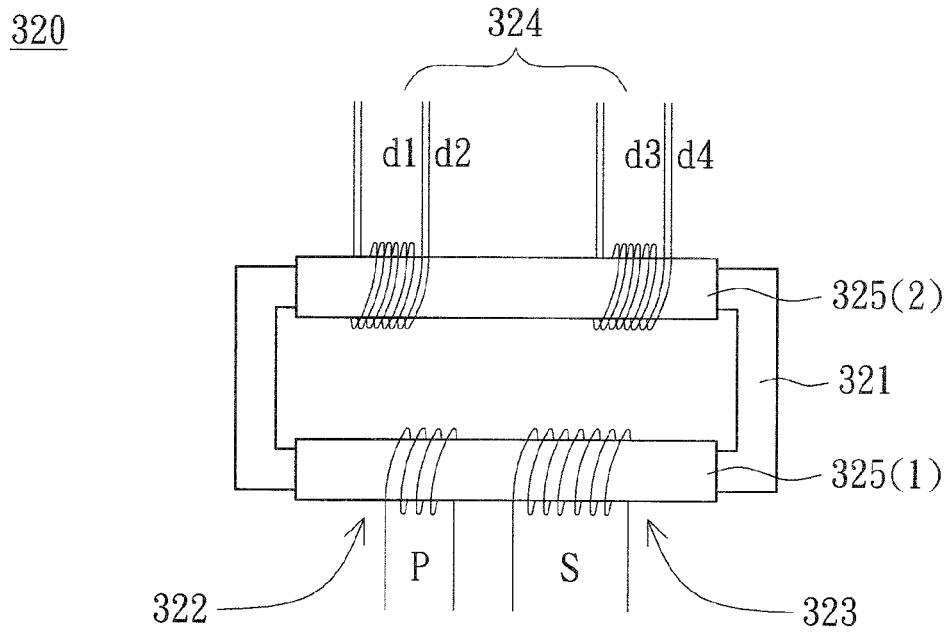
FIG. 17 is a schematic diagram showing a transformer according to a thirteenth embodiment of the invention.

FIG. 17 is a schematic diagram showing a transformer according to a thirteenth embodiment of the invention. As shown in FIG. 17, the transformer 320 of the embodiment is different from that of FIG. 16 in that the balancing winding set 324 further includes a third balancing coil d3 and a fourth balancing coil d4 which wind around the core in a combinative way in the transformer 320 of FIG. 17.

FOURTEENTH EMBODIMENT

Figure 18:
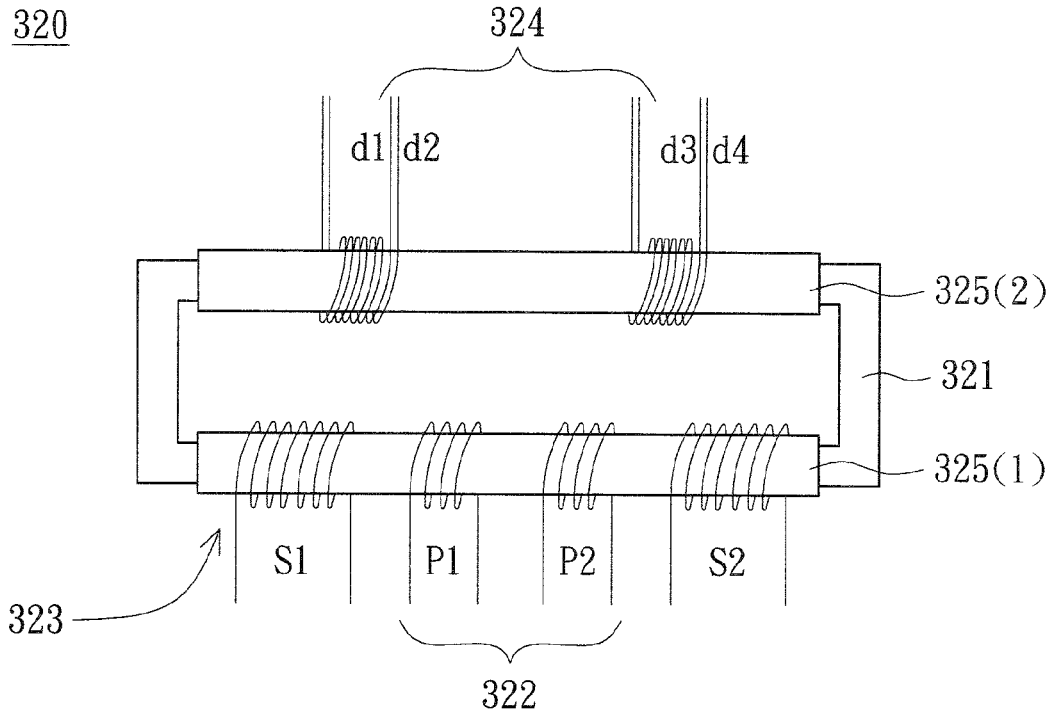
FIG. 18 is a schematic diagram showing a transformer according to a fourteenth embodiment of the invention.

FIG. 18 is a schematic diagram showing a transformer according to a fourteenth embodiment of the invention. As shown in FIG. 18, the transformer 320 of the embodiment is different from that of FIG. 17 in that the primary winding set 322 includes two primary coils P1 and P2, the secondary winding set includes two secondary coils S1 and S2, and the primary coils P1 and P2 are disposed between the secondary coils S1 and S2 in the transformer 320 of FIG. 18.

FIFTEENTH EMBODIMENT

Figure 19:
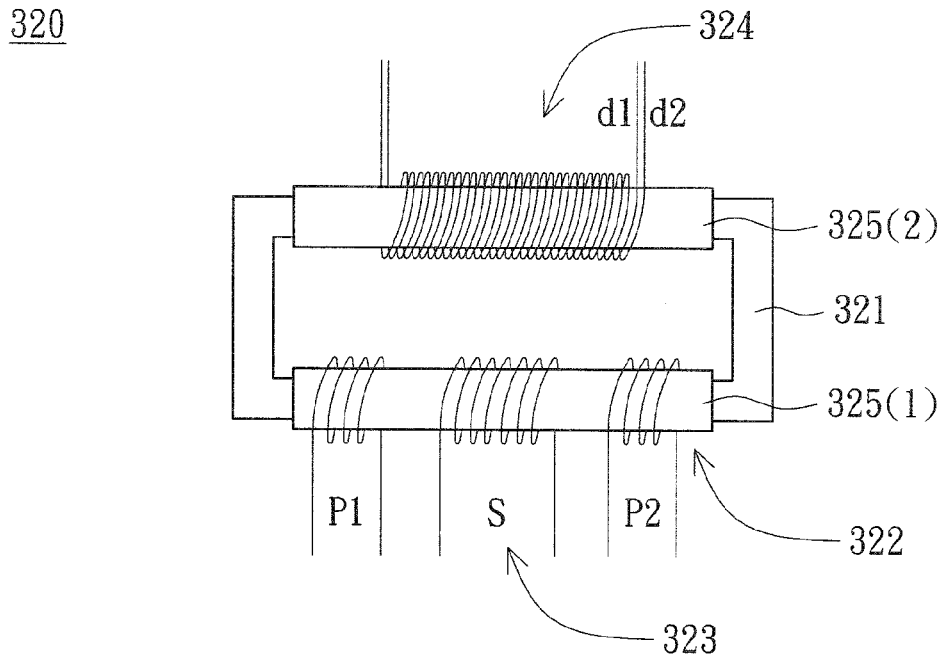
FIG. 19 is a schematic diagram showing a transformer according to a fifteenth embodiment of the invention.

FIG. 19 is a schematic diagram showing a transformer according to a fifteenth embodiment of the invention. As shown in FIG. 19, the transformer 320 of the embodiment is different from that of FIG. 16 in that the primary winding set 322 includes two primary coils P1 and P2 and the secondary winding set 323 is disposed between the primary coils P1 and P2 in the transformer 320 of FIG. 19.

SIXTEENTH EMBODIMENT

Figure 20:
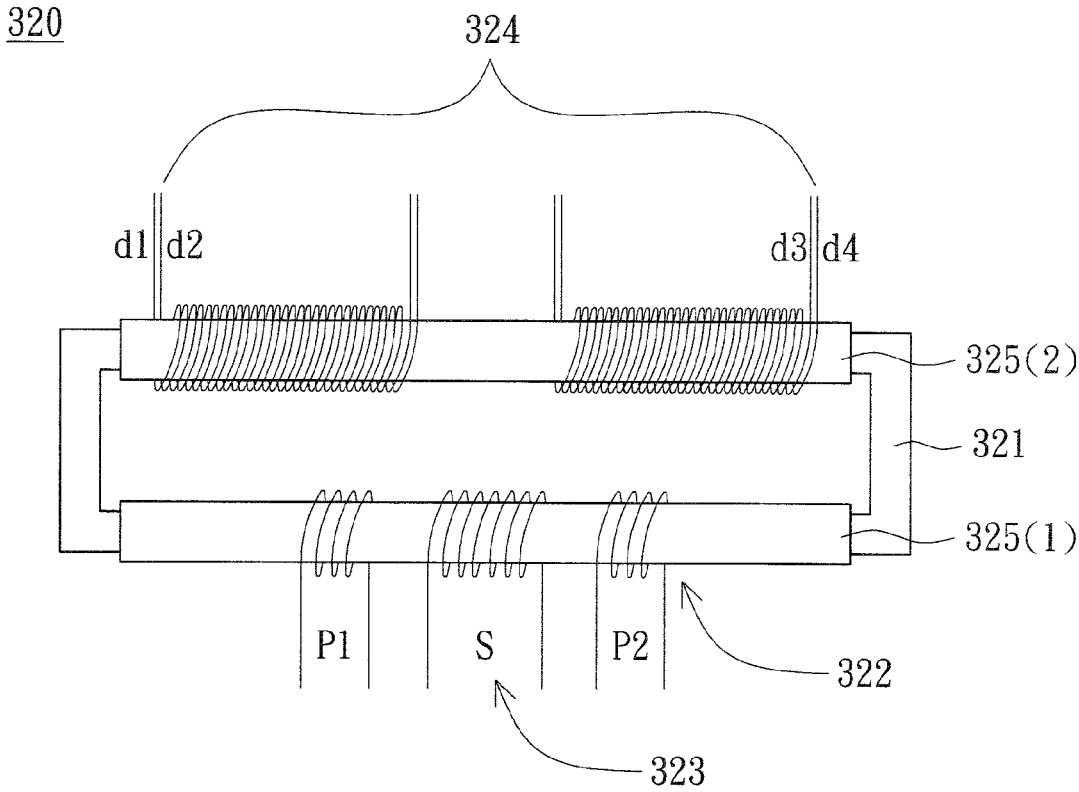
FIG. 20 is a schematic diagram showing a transformer according to a sixteenth embodiment of the invention.

FIG. 20 is a schematic diagram showing a transformer according to a sixteenth embodiment of the invention. As shown in FIG. 20, the transformer 320 of the embodiment is different from that of FIG. 19 in that the balancing winding set 324 further includes a third balancing coil d3 and a fourth balancing coil d4 which wind around the core in a combinative way in the transformer 320 of FIG. 20.

SEVENTEENTH EMBODIMENT

Figure 21:
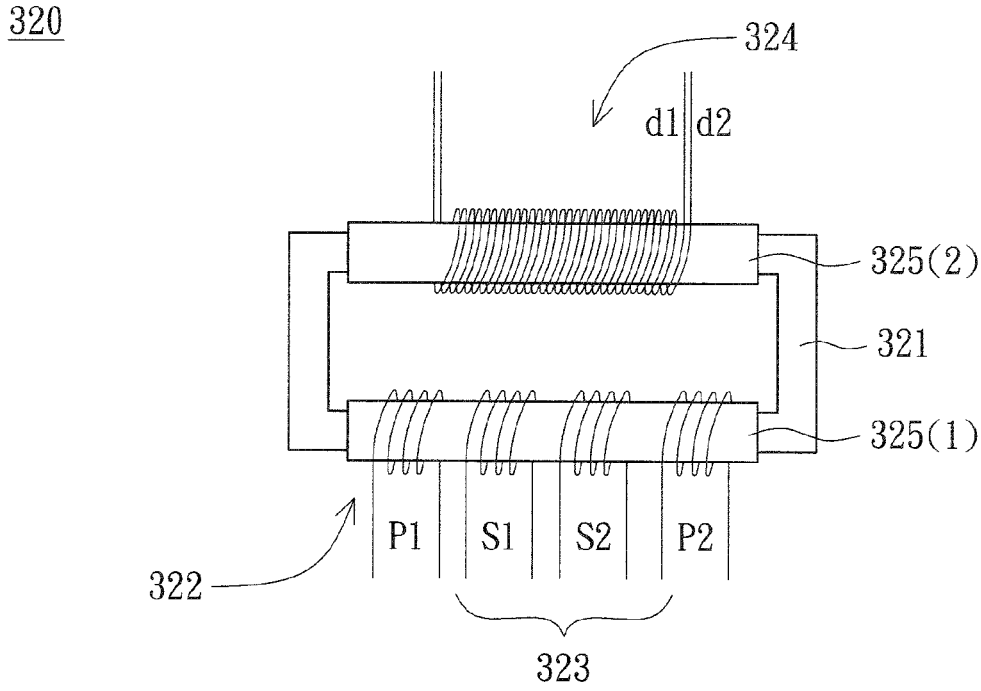
FIG. 21 is a schematic diagram showing a transformer according to a seventeenth embodiment of the invention.

FIG. 21 is a schematic diagram showing a transformer according to a seventeenth embodiment of the invention. As shown in FIG. 21, the transformer 320 of the embodiment is different from that of FIG. 19 is that the secondary winding set 323 includes two secondary coils S1 and S2 in the transformer 320 of FIG. 21.

EIGHTEENTH EMBODIMENT

Figure 22:
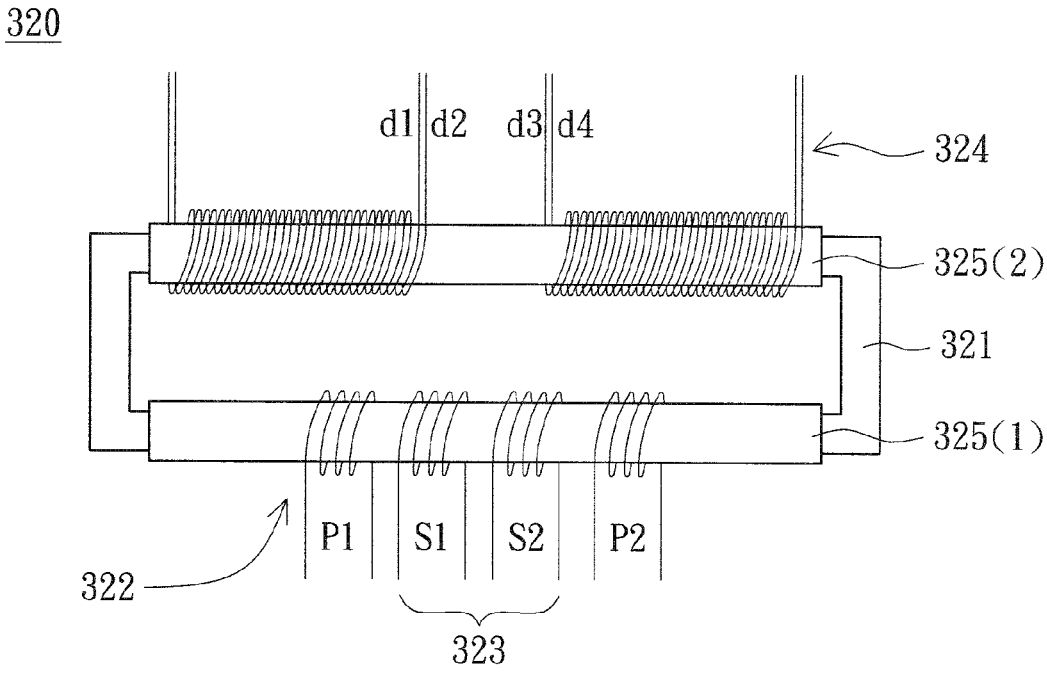
FIG. 22 is a schematic diagram showing a transformer according to an eighteenth embodiment of the invention.

FIG. 22 is a schematic diagram showing a transformer according to an eighteenth embodiment of the invention. As shown in FIG. 22, the transformer 320 of the embodiment is different from that of FIG. 21 in that the balancing winding set 324 further includes a third balancing coil d3 and a fourth balancing coil d4 which wind around the core in a combinative way in the transformer 320 of FIG. 22.

NINETEENTH EMBODIMENT

Figure 23:
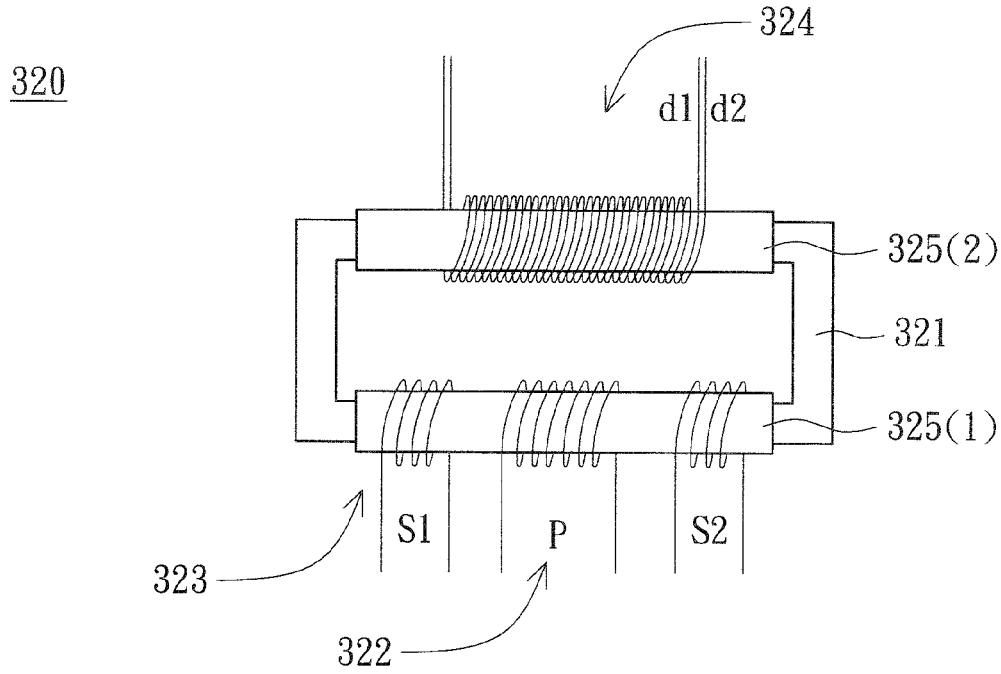
FIG. 23 is a schematic diagram showing a transformer according to a nineteenth embodiment of the invention.

FIG. 23 is a schematic diagram showing a transformer according to a nineteenth embodiment of the invention. As shown in FIG. 23, the transformer 320 of the embodiment is different from that of FIG. 16 in that the secondary winding set 323 includes two secondary coils S1 and S2 in the transformer 320 of FIG. 23, wherein the primary winding set 322 is disposed between the secondary coils S1 and S2.

TWENTIETH EMBODIMENT

Figure 24:
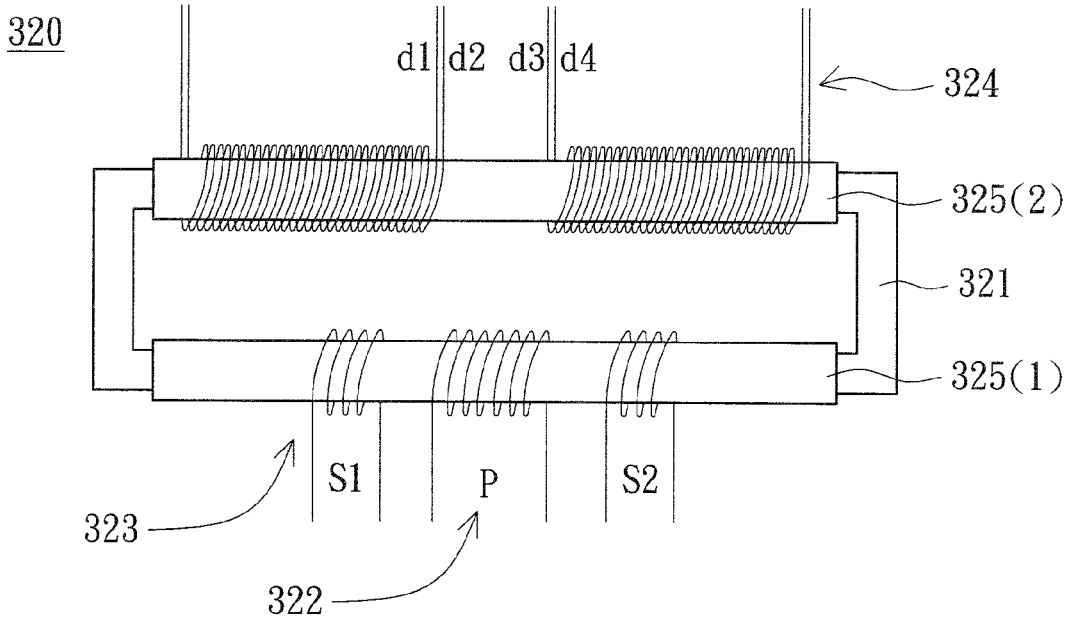
FIG. 24 is a schematic diagram showing a transformer according to a twentieth embodiment of the invention.

FIG. 24 is a schematic diagram showing a transformer according to a twentieth embodiment of the invention. As shown in FIG. 24, the transformer 320 of the embodiment is different from that of FIG. 23 in that the balancing winding set 324 further includes a third balancing coil d3 and a fourth balancing coil d4 which wind around the core in a combinative way in the transformer 320 of FIG. 24.

TWENTY-FIRST EMBODIMENT

Figure 25:
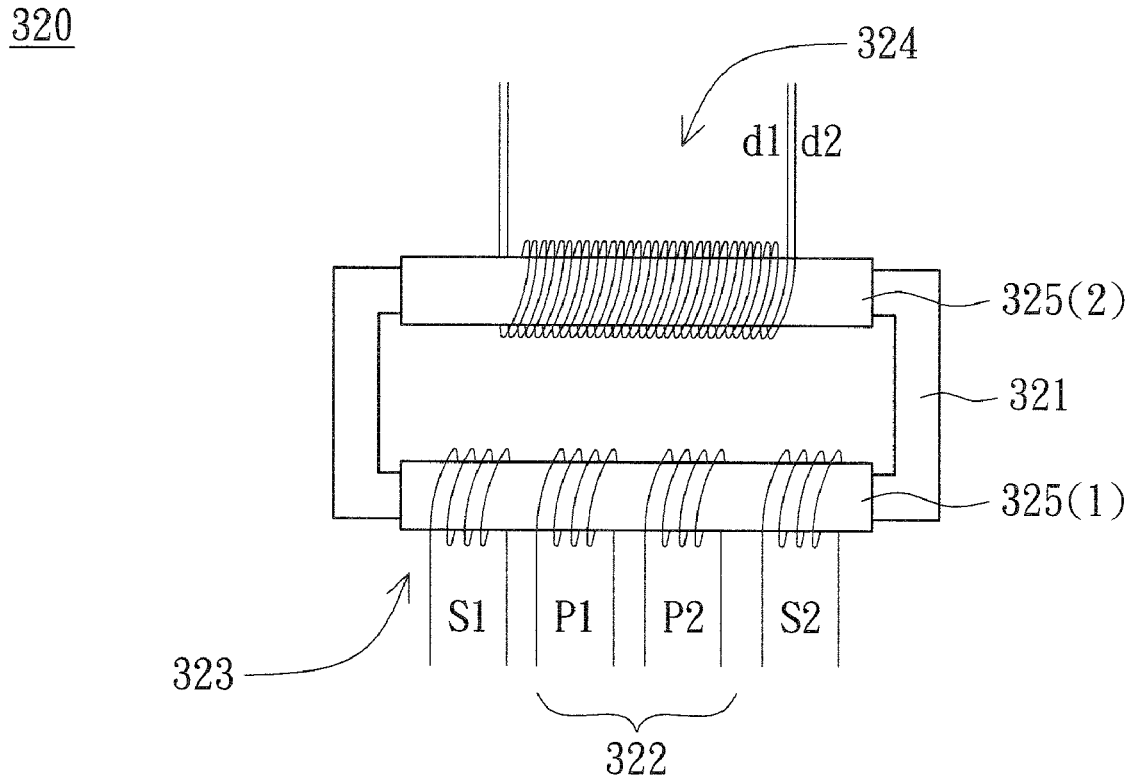
FIG. 25 is a schematic diagram showing a transformer according to a twenty-first embodiment of the invention.

FIG. 25 is a schematic diagram showing a transformer according to a twenty-first embodiment of the invention. As shown in FIG. 25, the transformer 320 of the embodiment is different from that of FIG. 23 in that the primary winding set 322 includes two primary coils P1 and P2 in the transformer 320 of FIG. 25.

However, one of ordinary skill in the art may easily understand that the invention is not limited thereto. The primary winding set, the secondary winding set and the balancing winding set may flexibly wind around one bobbin or multiple bobbins according to the type of the used core. The number of coils in each winding set and the relative arrangement thereof may be modified so that the transformer of the invention may be modified in response to various coupling architectures of the multi-lamp driving circuits. Any modification may fall within the scope of the invention as long as the transformer uses multiple winding sets to drive multiple lamps and balance the lamp currents simultaneously, and uses the method of winding the coils in a combinative manner to enhance the balancing effect.

According to the transformer and the multi-lamp driving circuit using the same in each embodiment of the invention, a single transformer is used to drive multiple lamps and the effect of balancing the lamp currents can be achieved without the use of the additional balancing transformer. In addition, the transformer of the invention also has the balancing coils which wind around the core in a combinative manner so that the time for winding may be shortened, and the good coil coupling effect and the better current balancing control can be achieved. Consequently, the multi-lamp driving circuit can effectively save the manufacturing cost and simplify the circuit complexity.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transformer for driving a plurality of lamps, the transformer comprising:

a core;

a primary winding set, winding set around the core and comprising a first primary coil;

a secondary winding set, winding set around the core and comprising a first secondary coil; and a balancing winding set, winding set around the core and comprising a first balancing coil and a second balancing coil winding set around the core in a combinative way, wherein the primary winding set, the secondary winding set and the balancing winding set have the same magnetic-flux loop in the core.

2. The transformer according to claim 1, wherein the first balancing coil and the second balancing coil have substantially the same number of windings.

3. The transformer according to claim 1, further comprising a bobbin disposed in the core, wherein the primary winding set, the secondary winding set and the balancing winding set wind around the bobbin.

4. The transformer according to claim 3, wherein the secondary winding set is disposed between the primary winding set and the balancing winding set.

5. The transformer according to claim 3, wherein the balancing winding set is disposed between the primary winding set and the secondary winding set.

6. The transformer according to claim 3, wherein the balancing winding set further comprises a third balancing coil and a fourth balancing coil winding set around the core in a combinative way, the first balancing coil is disposed between the primary winding set and the secondary winding set, and the secondary winding set is disposed between the first balancing coil and the third balancing coil.

7. The transformer according to claim 1, further comprising a first bobbin and a second bobbin disposed in the core, wherein the primary winding set, the secondary winding set and the balancing winding set wind around the first bobbin or the second bobbin.

8. The transformer according to claim 7, wherein the secondary winding set winds around the first bobbin, and the primary winding set and the balancing winding set wind set around the second bobbin.

9. The transformer according to claim 7, wherein the primary winding set and the secondary winding set wind around the first bobbin, and the balancing winding set winds around the second bobbin.

10. The transformer according to claim 9, wherein the primary winding set further comprises a second primary coil disposed between the first primary coil and the second primary coil.

11. The transformer according to claim 10, wherein the balancing winding set further comprises a third balancing coil and a fourth balancing coil winding set around the core in a combinative way.

12. The transformer according to claim 10, wherein the secondary winding set further comprises a second secondary coil.

13. The transformer according to claim 9, wherein the secondary winding set further comprises a second secondary coil, and the primary winding set is disposed between the first secondary coil and the second secondary coil.

14. The transformer according to claim 1, wherein the secondary winding set is coupled to a plurality of lamps through the balancing winding set.

15. The transformer according to claim 1, wherein the secondary winding set is coupled to a plurality of lamps and is coupled to the balancing winding set through the lamps.

16. A multi-lamp driving circuit for driving a plurality of lamps, the multi-lamp driving circuit comprising:

a driving circuit; and a transformer, comprising:

a core;

a primary winding set, winding set around the core and coupled to the driving circuit, the primary winding set comprising a primary coil;

a secondary winding set, winding set around the core and comprising a first secondary coil; and a balancing winding set, winding set around the core and comprising a first balancing coil and a second balancing coil winding set around the core in a combinative way, wherein the secondary winding set is coupled to the lamps through the balancing winding set, and the primary winding set, the secondary winding set and the balancing winding set have the same magnetic-flux loop in the core.

17. The multi-lamp driving circuit according to claim 16, wherein the lamps comprise four lamps, the balancing winding set further comprises a third balancing coil and a fourth balancing coil winding set around the core in a combinative way, first ends of the first to fourth balancing coils are respectively coupled to first ends of the four lamps, second ends of the first to fourth balancing coils are respectively coupled to two ends of the first secondary coil, and second ends of the four lamps are grounded.

18. The multi-lamp driving circuit according to claim 16, wherein the lamps comprises two lamps, first ends of the first and second balancing coils are respectively coupled to first ends of the two lamps, second ends of the first and second balancing coils are coupled to a first end of the first secondary coil, and second ends of the first secondary coil and the two lamps are grounded.

19. The multi-lamp driving circuit according to claim 16, wherein the secondary winding set further comprises a second secondary coil, the lamps comprises two lamps, first ends of the first and second balancing coils are respectively coupled to first ends of the lamps, second ends of the first and second balancing coils are respectively coupled to first ends of the first and second secondary coils, and second ends of the first and second secondary coils are grounded.

20. A multi-lamp driving circuit for driving a plurality of lamps, the multi-lamp driving circuit comprising:

a driving circuit; and a transformer, comprising:

a core;

a primary winding set, winding set around the core and coupled to the driving circuit, the primary winding set comprising a primary coil;

a secondary winding set, winding set around the core and comprising a secondary coil; and a balancing winding set, winding set around the core and comprising a first balancing coil and a second balancing coil winding set around the core in a combinative way, wherein the secondary winding set is coupled to the lamps and is coupled to the balancing winding set through the lamps, and the primary winding set, the secondary winding set and the balancing winding set have the same magnetic-flux loop in the core.

21. The multi-lamp driving circuit according to claim 20, wherein the lamps comprise four lamps, the balancing winding set further comprises a third balancing coil and a fourth balancing coil winding set around the core in a combinative way, first ends of the first to fourth balancing coils are respectively coupled to first ends of the four lamps, second ends of the four lamps are respectively coupled to two ends of the secondary coil, and second ends of the first to fourth balancing coils are grounded.

22. The multi-lamp driving circuit according to claim 20, wherein the lamps comprise two lamps, first ends of the first and second balancing coils are respectively coupled to first ends of the two lamps, second ends of the two lamps are coupled to a first end of the secondary coil, second ends of the first and second balancing coils and the secondary coil are grounded.

23. A multi-lamp driving circuit for driving a first lamp and a second lamp, the multi-lamp driving circuit comprising:

a driving circuit; and a transformer, comprising:

a core;

a primary winding set, winding set around the core and coupled to the driving circuit, the primary winding set comprising a primary coil;

a secondary winding set, winding set around the core and comprising a first secondary coil; and a balancing winding set, winding set around the core and comprising a first balancing coil and a second balancing coil winding set around the core in a combinative way, and a third balancing coil and a fourth balancing coil winding set around the core in a combinative way, wherein two ends of the first lamp are respectively coupled to first ends of the second and third balancing coils, two ends of the second lamp are respectively coupled to first ends of the first and fourth balancing coils, the first and second lamps are coupled to the first secondary coil through the first to fourth balancing coils, and the primary winding set, the secondary winding set and the balancing winding set have the same magnetic-flux loop in the core.

24. The multi-lamp driving circuit according to claim 23, wherein second ends of the first to fourth balancing coils are respectively coupled to two ends of the first secondary coil.

25. The multi-lamp driving circuit according to claim 23, wherein the secondary winding set further comprises a second secondary coil, second ends of the first to fourth balancing coils are respectively coupled to first ends of the first and second secondary coils, and second ends of the first and second secondary coils are grounded.

* * * * *